US005453343A

United States Patent [19]

Liu et al.

[11] Patent Number: 5,453,343

[45] Date of Patent: Sep. 26, 1995

[54] HYDRAZONE COMPOUNDS AS CHARGE TRANSPORT MATERIAL IN PHOTORECEPTORS

[75] Inventors: Jia-Ming Liu, Hsinchu; Shih-Ying Shen, Tainan; Kuei-Fei Teng, Kaohsiung, all of Taiwan

[73] Assignee: Industrial Technology Research Institute, Chutung, Taiwan

[21] Appl. No.: 15,398

[22] Filed: Feb. 9, 1993

[51] Int. Cl.[6] ..... G03G 5/047; G03G 5/06

[52] U.S. Cl. ..... 430/59; 430/73; 430/74

[58] Field of Search ..... 430/59, 73, 74

[56] References Cited

U.S. PATENT DOCUMENTS

| | | | |
|---|---|---|---|
| 4,150,987 | 4/1979 | Anderson | 96/1.5 R |
| 4,487,824 | 12/1984 | Katagiri et al. | 430/58 |
| 4,666,809 | 5/1987 | Matsumoto | 430/76 |
| 4,830,994 | 5/1989 | Umehara | 430/59 |
| 4,957,836 | 9/1990 | Chen | 430/59 |
| 4,987,045 | 1/1991 | Suzuki et al. | 430/59 |

FOREIGN PATENT DOCUMENTS 3-2760 1/1991 Japan .

OTHER PUBLICATIONS

English Translation of JP 3–2760.

*Primary Examiner*—Marion E. Mc Camish
*Assistant Examiner*—Rosemary Ashton
*Attorney, Agent, or Firm*—W. Wayne Liauh

[57] ABSTRACT

Organic photoreceptors of the functionally separated laminated type containing a hydrazone compound in the charge transport layer thereof which provides low crystallinity and improved sensitivity, durability, and reproducibility. The hydrazone compound disclosed in the present invention is presented by the following general formula (I):

wherein $R_1$ represents a substituted or unsubstituted $C_1$–$C_4$ alkyl group, $R_2$ represents a hydrogen atom, or an alkyl or alkoxy group; n is an integer of either 1 or 2; $R_3$ and $R_4$ each independently represents a substituted or unsubstituted alkyl group, a substituted or unsubstituted aryl group or a substituted or unsubstituted aralkyl group; or alternatively $R_3$ and $R_4$ form a substituted or unsubstituted aromatic heterocyclic ring residue cojointly with the nitrogen atom to which they are bonded.

15 Claims, No Drawings

HYDRAZONE COMPOUNDS AS CHARGE TRANSPORT MATERIAL IN PHOTORECEPTORS

FIELD OF THE INVENTION

This invention relates to new hydrazone compounds for use as charge transport material in photoreceptors. More particularly, this invention relates to functionally separated laminated type photoreceptors containing a hydrazone compound in the charge transport layer thereof which provides improved sensitivity, durability, and reproducibility.

BACKGROUND OF THE INVENTION

Xerox copiers and laser printers have become an essential and almost indispensable part of today's office environment. With the advent of rapid technology growth and information explosion, the desire to provide improved copiers and/or printers always presents a constant challenge.

Both the xerox-type copiers and the laser printers involve the technique of xerography, which, in essence, is an electrophotographic process. The key element in the xerographic technique is an electrophotoreceptor, or photoreceptor, which is an optical element electrically insulative in darkness but becomes electrically conductive after exposure to selected light beams. Photoreceptors play key roles in all the six main steps in the electrophotographic process: charging, photocharging, imaging, image transfer, development, and cleaning. In order to obtain high-quality printed images, photoreceptors should have high charge acceptance, low dark conductivity and high sensitivity. Another requirement that arises as a result of the substantially increased speed in today's xerox copiers and laser printers is that the photoreceptor must be able to retain its quality after a large number of repeated use.

A photoreceptor is a material which is capable of generating and transporting electron-hole pairs after absorbing photon particles. Photoreceptors are typically classified as inorganic or organic types. Examples of inorganic photoreceptors include: selenium, cadmium sulfide, zinc oxide and amorphous silicon. Examples of organic photoreceptors include: photoconductive polymers such as poly-N-vinylcarbazole and polyvinylanthrancene; low molecular weight organic compounds such as carbazole, anthracene, oxadiazole, certain hydrazones and certain polyarylalkanes; organic pigments or dyes such a phthalocyanine pigment, azo pigment, cyanine pigment, polycyclic quinone pigment, perylene pigment, indigo dye, thioindigo dye and squaraine dye, etc. Due to their advantages of low production cost, non-toxicity and high flexibility in utilization, organic photoreceptors (which are sometimes called organic photoconductors, or OPC) have largely replaced inorganic photoreceptors as the predominant photoreceptors among the commercialized photoreceptors.

Photoreceptors may also be classified according to their structures into three main types: (1) mono layer type photoreceptors, such as that disclosed in U.S. Pat. No. 3,484,237, (2) functionally separated laminated type photoreceptors, such as those described in U.S. Pat. Nos. 3,837,851, 3,850,630, 4,123,270 and 4,293,628, and (3) microcrystalline distribution type photoreceptors. The functionally separated laminated type photoreceptors typically comprise a conductive substrate, a charge generation layer (CGL) and a charge transport layer (CTL). Optionally a barrier layer or an adhesive layer may be sandwiched between the conductive substrate and the charge generation layer. In the production of the photoreceptors of the functionally separated laminated type, a charge generation layer comprising a charge generation material and a polymeric binder is coated on a conductive substrate, and then a charge transport layer comprising a charge transport material and another polymeric binder is coated thereupon.

Organic photoreceptor may be produced by selecting among a variety of suitable charge generation materials, suitable charge transport materials and suitable polymeric binders. U.S. Pat. No. 4,150,987 (the '987 patent) disclosed hydrazone-containing charge transport layer to be included in a layered electrophotographic plate. The hydrazone compounds disclosed in the '987 patent generally suffered low sensitivity problems. In U.S. Pat. No. 4,666,809 (the '809 patent), hydrazone compounds represented by two general formulas were disclosed for use in a lamination type of photosensitive member having improved sensitivity. The hydrazone compounds disclosed in the '987 patent involve relatively complicated molecular structure and are expensive to manufacture. U.S. Pat. No. 4,957,836 (the '836 patent) disclosed a new type of hydrazone compounds with simpler molecular structure; however, these hydrazone compounds exhibited undesirable crystallinity problems. U.S. Pat. No. 4,830,944 (the '944 patent) attempted to enumerate an exhaustive list of hydrazone compounds that may be used as charge transport material in electrophotographic process. However, undue experimentation would be required to sort out hydrazone compounds that may be suitable for the intended use. Furthermore, despite of the lengthy enumeration in the '944 patent, extensive research effort is still needed to develop new hydrazone compounds that could either provide improved properties over the prior art compounds or overcome some of the problems presented in the prior art charge transport materials.

SUMMARY OF THE PRESENT INVENTION

Having heretofore discussed the various disadvantages of photoreceptors disclosed in the prior art, it is thus the primary object of the present invention to develop a new hydrazone compound with simplified molecular structure for use as a charge transport material in an organic photoreceptor which provides low crystallinity, high sensitivity, and low residual potential.

The present invention discloses a photoreceptor comprising the components of: (a) an electrically conductive substrate; (b) a charge generation layer on top of the conductive substrate which comprises a charge generation material capable of generating electron-hole pair upon exposure to selected light rays; and (c) a charge transport layer which comprises a polymeric binder and a hydrazone compound presented by the following general formula (I):

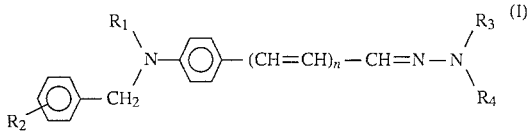

(I)

In the above formula, $R_1$ represents a substituted or unsubstituted $C_1$–$C_4$ alkyl group, $R_2$ represents a hydrogen atom, or an alkyl or alkoxy group; n is an integer of either 1 or 2; $R_3$ and $R_4$ each independently represents a substituted or unsubstituted alkyl group, a substituted or unsubstituted aryl group or a substituted or unsubstituted aralkyl group; or alternatively $R_3$ and $R_4$ form a substituted or unsubstituted aromatic heterocyclic ring residue cojointly with the nitrogen atom to which they are bonded.

A preferred group of hydrazone compounds disclosed in the present invention are compounds represented by the general formula (I) in which at least one of $R_3$ and $R_4$ is an aryl group.

A more preferred group of hydrazone compounds contemplated by the present invention are compounds of formula (I) in which $R_1$ is ethyl group, $R_2$ is hydrogen atom, and at least one of R3 and R4 is an aryl group.

Examples of the most preferred hydrazone compounds disclosed by the present invention are listed below:

(1)

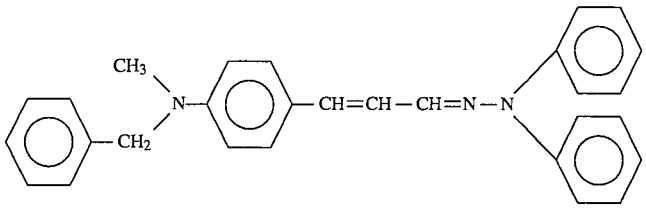

(2)

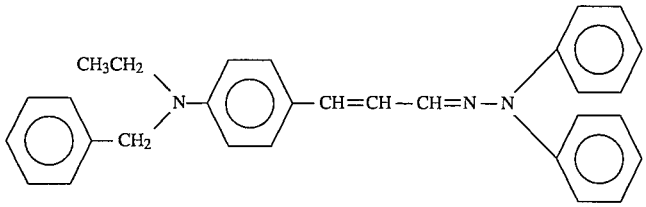

(3)

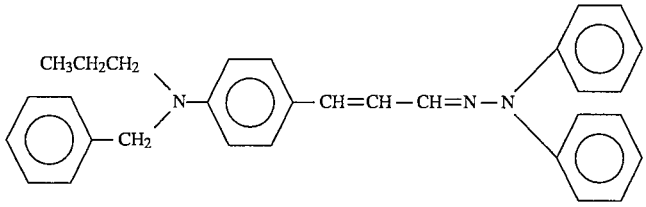

(4)

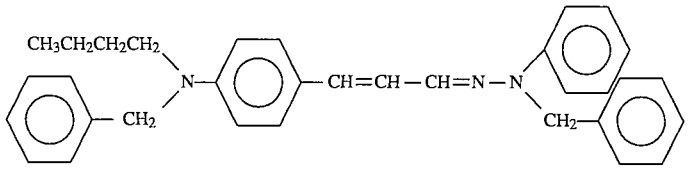

(5)

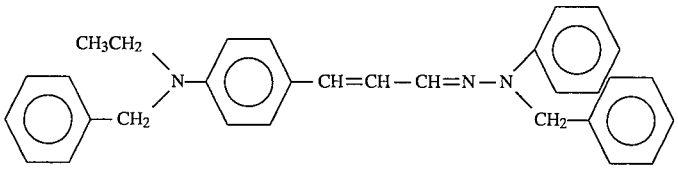

(6)

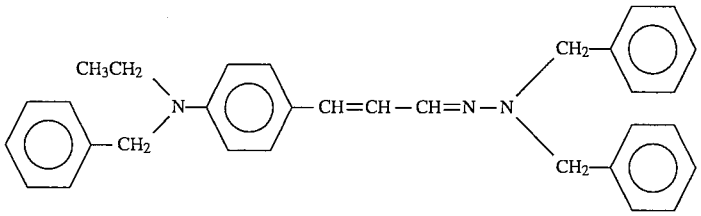

(7)

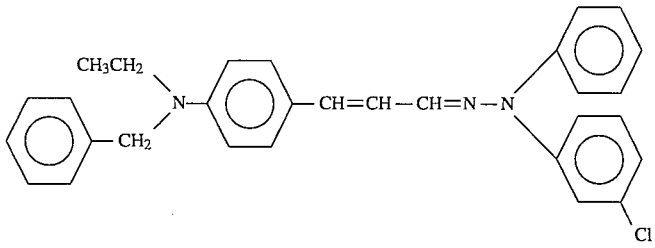

-continued
(8)
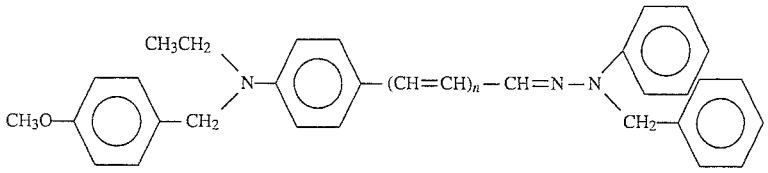
(9)
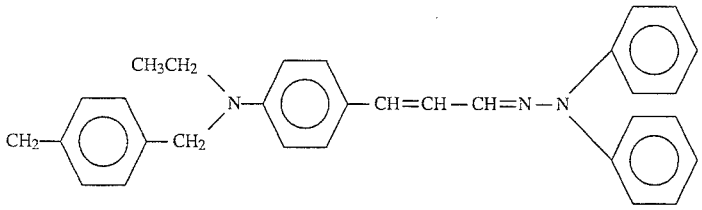
(10)
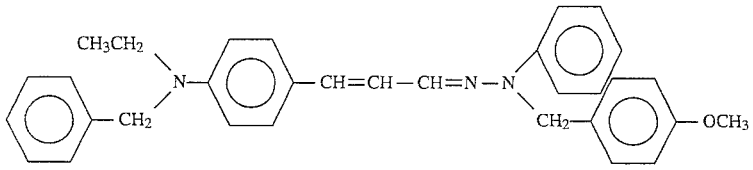
(11)
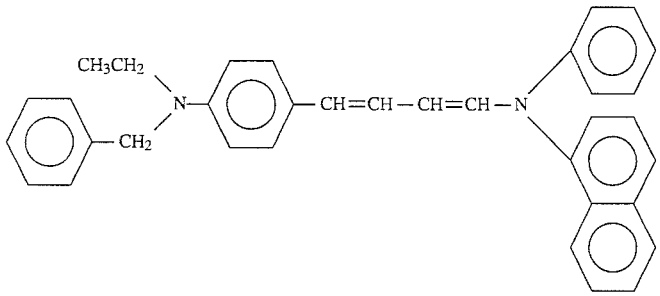
(12)
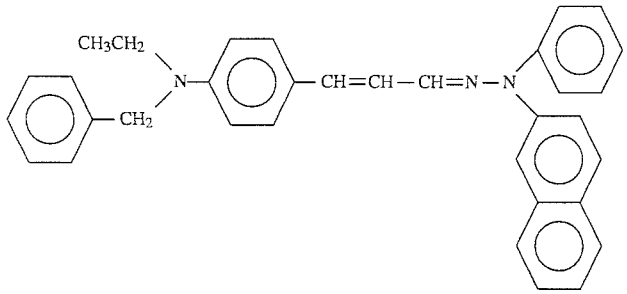
(13)
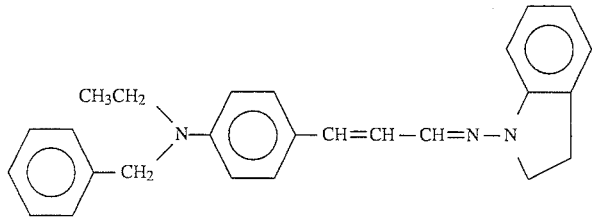
(14)
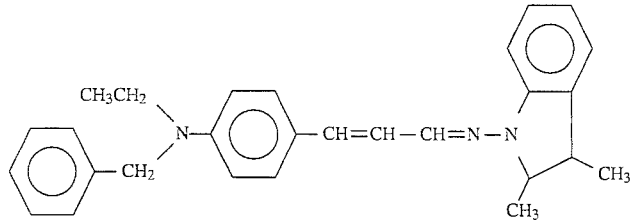

-continued (15)

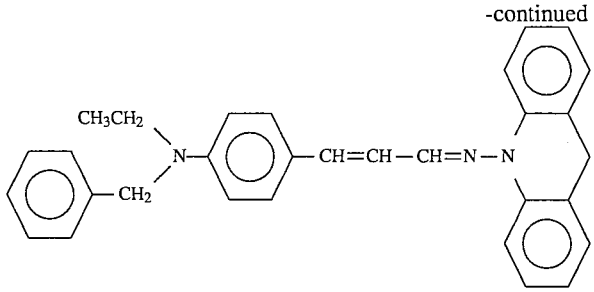

The hereinabove described hydrazone compounds can be obtained by reacting aldehyde with an equimolar amount of hydrazine in a suitable solvent. However, in the preferred embodiment, hydrazine is generally added in excess amount to ensure a complete reaction. After the reaction is completed, the hydrazone compound can be purified by recrystallization. Alcohol and methyl ethyl ketone are the preferred solvents.

In the production of the electrophotoreceptor disclosed in the present invention, the conductive substrate is first coated with a charge generation layer then a charge transport layer. The charge generation layer comprises a charge generation material and a polymeric binder; whereas, the charge transport layer comprises one of the above-described hydrazone in another polymeric binder. These coatings can be effected using blade coating, dipping or spraying technique.

The dry film thickness of the charge generation layer can range from 0.01 $g/m^2$ to 4 $g/m^2$, preferably from 0.04 $g/m^2$ to 2 $g/m^2$. The dry film thickness of the charge transport layer can range from 3 to 50 μm, preferably from 12 to 25 μm. The amount of the hydrazone compound in the charge transport layer can range from 10 wt. % to 90 wt. %, preferably from 40 wt. % to 80 wt. %.

In the present invention, either an organic or inorganic charge generation material can be used in the charge generation layer. Examples of inorganic charge generation materials include inorganic pigments such as selenium, selenium-tellurium alloy, selenium-arsenic alloy and cadmium sulfide, etc. Examples of organic charge generation materials include organic pigments such as phthalocyanine pigment, perinone pigment, thioindigo pigment, quinacridone pigment, perylene pigment, anthraquine pigment, azo pigment, bisazo pigment, cyanine pigment and squaraine pigment, etc.

Certain compounds, which are capable of forming a complex compound with the hydrazone compound disclosed in the present invention, can also be added in the charge transport layer to improve the photoconductivity thereof. Examples of these compounds include: quinones such as chloranil, 2,3-dichloro-1,4-naphthoquinone, 1-chloro-5-nitro anthraquinone; aldehydes such as 4-nitrobenzaldehyde; ketones such as indandione, 3,5-dinitrobenzophenone, 2,4,7-trinitrofluorenone; anhydrides such as phthalic anhydride, 4-chloro-naphthalic anhydride; cyanide such as terephthalmalonitrile; phthalides such as benzal phthalide, 3-α-cyano-p-nitrobenzal phthalide, etc.

Examples of the polymeric binders which can be used in combination with the hydrazone compounds of the present invention in the charge transport layer include: vinyl polymers; copolymers of styrene, vinyl acetate, acrylates; polyvinyl acetates; polycarbonates; polyesters; polysulfones; polyphenylene oxides; polyurethanes; cellulose esters, etc.

Optionally, an adhesive layer may be introduced between the conductive substrate and the charge generation layer to prevent the reverse injection of electrons from the conductive substrate into the charge generation layer. Examples of those materials that are suitable for such use include: polyamides, polyvinyl alcohol, casein, nitro cellulose and methyl cellulose, etc. The thickness of the adhesive layer can range from 1 to 4 μm.

Furthermore, a plasticizer may be optionally added in charge transport layer to improve the film forming ability thereof. Examples of plasticizers suitable for such use include: phthalic acid ester, epoxy compounds, chlorinated paraffin, methyl-naphthalene, etc.

The hydrazone compounds disclosed in the present invention have a simplified molecular structure, provide high charge transport efficiency, can be used in conjunction with a wide variety of charge generation materials, and possess high compatibility with many different types of polymeric binders. Furthermore, the hydrazone compounds of this invention exhibit high transparency which facilitates the transmission of incident light through the charge transport layer and allows a complete absorption of incident light by the charge generation layer.

The photoreceptors produced containing the hydrazone compounds disclosed in the present invention have shown to increase sensitivity, lower residual potential, and exhibit excellent reproducibility. Reproducibility is manifested by the absence of accumulation of residual potential after several thousand times of repeated use.

DETAILED DESCRIPTION OF THE PREFERRED EMBODIMENT

The present invention will now be described more specifically with reference to the following examples. It is to be noted that the following descriptions of examples including preferred embodiments of this invention are presented herein for purposes of illustration and description; it is not intended to be exhaustive or to limit the invention to the precise form disclosed. Obvious modifications or variations are possible in light of the above teachings. The embodiments were chosen and described to provide the best illustration of the principles of this invention and its practical application to thereby enable one of the ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

EXAMPLE 1

Preparation of N-ethyl-N-benzyl cinnamaldehyde 232 ml of DMF (N,N-dimethylformamide) was added into a 500-ml round-bottomed beaker. Under an ice bath (0°–5° C.), 93.2 ml of $POCl_3$ was gradually added to the solution. The mixture was stirred at a temperature of 0° C. for 2 hours. Then 42.2 g of N-ethyl-N-benzyl aniline was gradually added to the solution. Thereafter, the solution temperature was raised to 90° C. using an oil bath. The reaction was allowed to proceed for 2.5 hours, and then the reaction mixture was cooled and poured into 500 ml of ice water. The resultant solution was neutralized under an ice bath using a 50% NaOH solution until the solution pH reached a value of 8. The solution was allowed to stand overnight.

Thereafter, the upper layer of an aqueous solution was discarded, and a brownish viscous oily product in the lower layer was obtained. The viscous oily product was dried and then dissolved into 50 ml of dry THF (tetrahydrofuran). After complete dissolution, the solution was added drop by drop into a solution containing 46.4 g (triphenyl-P)$^+$-($CH_3Br$)$^-$ and 3.3 g $LiNH_2$ in 200 ml THF which has been under reflux for 2 hours. The solution continued to be placed in reflux overnight and then was cooled to room temperature. After the solvent THF was removed, 28 g of crude product was obtained. The crude product was converted to N-ethyl-N-benzyl cinnamaldehyde using 60 ml $POCl_3$ and 151 ml DMF at 0° C. 34.3 g of such N-ethyl-N-benzyl cinnamaldehyde was obtained. The yield was calculated to be 65%.

EXAMPLE 2

Preparation of Hydrazone Compound 2

5.9 g of N-ethyl-N-benzyl cinnamaldehyde prepared from Example 1 was added to 150 ml of ethanol. At room temperature, 4.9 g of a hydrazine compound of the following formula:

(2a)

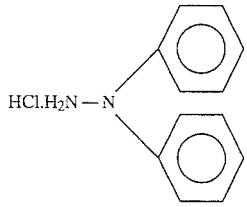

was added to the solution, which was then stirred for 15 minutes and neutralized using 1 N NaOH solution under an ice bath until the solution pH reached 8 and precipitation occurred. After filtering, the precipitate was triple-crystallized using methyl ethyl ketone and ethanol. 5.32 g of hydrazone compound 2 was obtained which has the following formula:

(2)

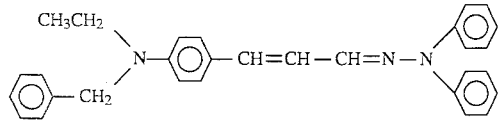

The yield was 56%.

EXAMPLE 3

Preparation of Hydrazone Compound 5

Hydrazone compound No. 5 was prepared in the same manner as in Example 2, except that a different hydrazine compound was used which has the following formula:

(5a)

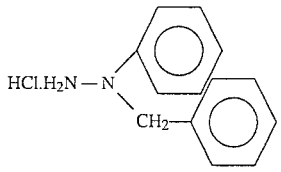

The yield was 49%. The hydrazone compound so obtained has the following formula:

(5)

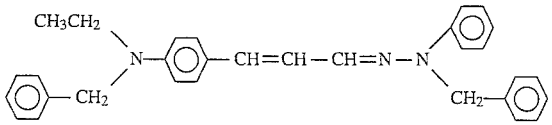

EXAMPLE 4

Preparation of Hydrazone Compound 6

Hydrazone compounds No. 6 was prepared in the same manner as in Example 2, except that a different hydrazine compound was used which has the following formula:

(6a)

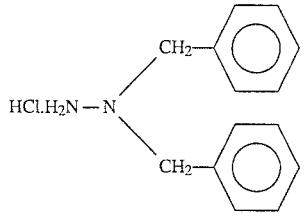

The yield was 53%. The hydrazone compound so obtained has the following formula:

(6)

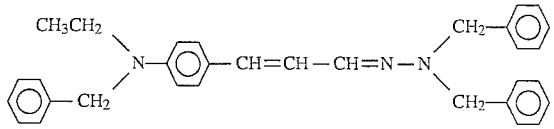

EXAMPLE 5

A binder mixture containing 10 g of a polyamide copolymer (CM8000, from Torry Co., Japan), 60 g of methanol, and 40 g of n-butanol was dip-coated on an aluminum plate having a thickness of 0.2 mm. The coating composition was then dried by heating in a hot air oven at 95 ° C. for 20 minutes. An adhesive layer having a thickness of 1.0 g/m$^2$ was obtained.

Next, a coating composition to be used in the charge generation layer and containing 0.68 g of epsilon-type copper phthalocyanine (Heleigen Blue L0700, from BASF), 0.75 g of polyvinyl butyral "BM2", from Sokisui Co. of Japan), 24.25 g of cyclohexanone, 0.068 g of hydroxy squaraine (HOSq) of the formula:

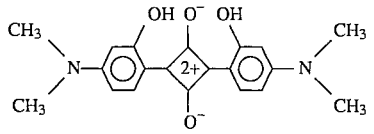

and 24.25 g of methyl ethyl ketone was prepared by a mixing procedure for 6 hours using a micronizing mill (from McCrone, United Kingdom). The resultant coating composition was applied onto the above prepared adhesive layer using a dipping procedure and dried by heating in a hot air oven at 95° C. for 20 minutes. A charge generation layer having a thickness of 0.3 g/m$^2$ was obtained.

Subsequently, a charge transport coating composition containing 0.6 g of hydrazone compound 2 prepared from Example 2, 0.9 g of a styrene-maleic anhydride copolymer (Dylark 232, from Arco Co., Japan), and 4.275 g of toluene as the solvent, was coated on top of the charge generation layer and then dried by heating in an oven at 100° C. for 20 minutes. A charge transport layer having a thickness of 20 gm was obtained.

The resultant organic photoreceptor of the present invention was tested using an Electrostatic paper Analyzer Model EPA-8100, manufactured by Kawaguchi Electric, Japan, to determine its photo-conductivity. The corona charge was set at 5.0 kV and the corona charge speed was set at 5 m/min. The initial surface potential of the sample was recorded and designated as $V_o$. After 2 seconds of dark decay, the surface potential was recorded and designated as $V_2$. The sample was then exposed under a tungsten light source of 10 lux intensity, and the surface potential began to attenuate. The light energy consumed when the surface potential dropped to one half of the value of $V_2$ (half decay exposure) was calculated and recorded as $E_{1/2}$ (in lux. sec). The surface potential after exposure under the tungsten light source was recorded as $V_R$. For hydrazone compound 2, the following results were obtained:

$V_o$=830 volt, $E_{1/2}$=0.5 lux.sec, $V_R$=40 volt

After 1,000 times of repeated tests, the following resulted were obtained:

$V_o$=780 volt, $E_{1/2}$=0.8 lux.sec, $V_R$=40 volt

EXAMPLE 6

An organic photoreceptor of the present invention was prepared in the same manner as in Example 5, except that hydrazone compound 5 prepared from Example 3 was used instead of hydrazone compound 2. The following results were obtained:

$V_o$=850 volt, $E_{1/2}$=0.8 lux.sec, $V_R$=40 volt

After 2,400 times of repeated tests, the following resulted were obtained:

$V_o$=810 volt, $E_{1/2}$=0.8 lux.sec, $V_R$=16 volt

EXAMPLE 7

Another organic photoreceptor of the present invention was prepared in the same manner as in Example 5, except that hydrazone compound 6 was used instead of hydrazone compound 2. The following results were obtained:

$V_o$=860 volt, $E_{1/2}$=5 lux.sec, $V_R$=22 volt

EXAMPLE 8

Comparative Example

An organic photoreceptor was prepared in the same manner as in Example 5, except that the following compound was used as the charge transport material:

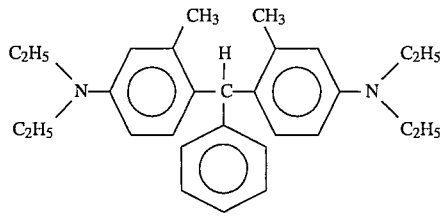

and the solvent was replaced by THF. The following results were obtained:

$V_o$=1,007 volt, $E_{1/2}$=18.2 lux.sec, $V_R$=272 volt

As shown by the above examples, the photoreceptors embodying the hydrazone compound disclosed in the present invention as a charge transport material provide high sensitivity and low residual surface potential. Furthermore, because the hydrazone compounds of the present invention are of simplified molecular structure, economic benefits can be realized.

What is claimed is:

1. A photoreceptor comprising:

(a) an electrically conductive substrate;

(b) a charge generation layer comprising a charge generation material; and (c) a charge transport layer comprising a polymeric binder and a hydrazone compound represented by the following general formula (I):

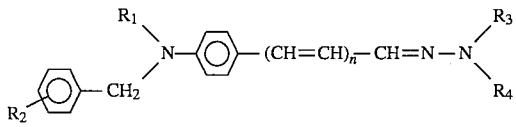

(I)

wherein $R_1$ represents a substituted or unsubstituted $C_1$–$C_4$ alkyl group, $R_2$ represents a hydrogen atom, an alkyl or an alkoxy group; $R_3$ and $R_4$ each independently represents a substituted or unsubstituted alkyl group, a substituted or unsubstituted aryl group, or a substituted or unsubstituted aralkyl group; or alternatively $R_3$ and $R_4$ form a substituted or unsubstituted aromatic heterocyclic ring residue cojointly with the nitrogen atom to which they are bonded; and n is an integer of 1 or 2.

2. The photoreceptor of claim 1, wherein at least one of R3 and R4 is an aryl group.

3. The photoreceptor of claim 1, wherein R1 is ethyl group and R2 is hydrogen atom.

4. The photoreceptor of claim 1, wherein said hydrazone compound is selected from the group consisting of the compounds represented by the following formulas:

(2)

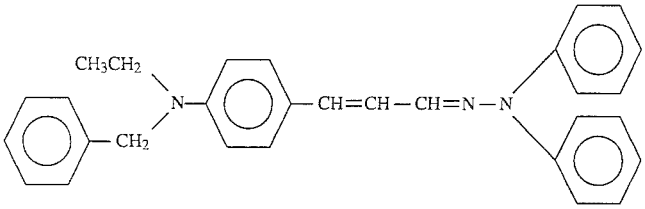

(5)

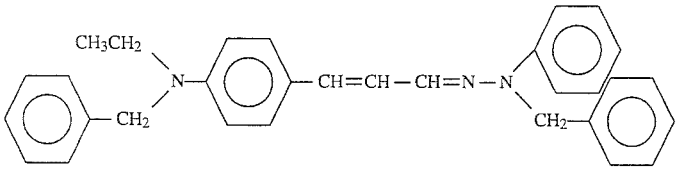

(6)

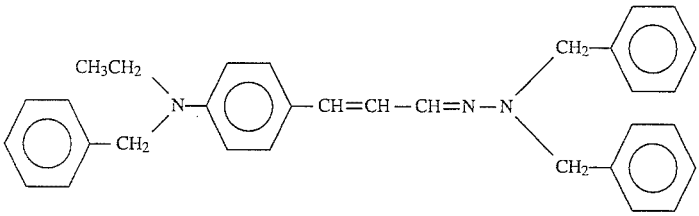

(16)

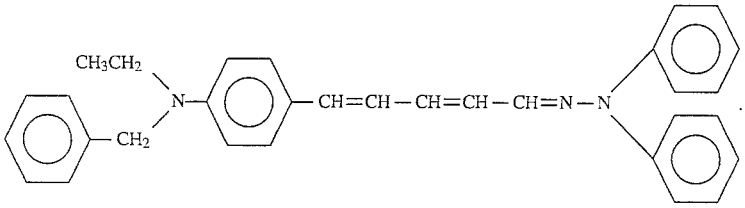

5. The photoreceptor of claim 1, wherein said hydrazone compound is represented by the following formula:

(2)

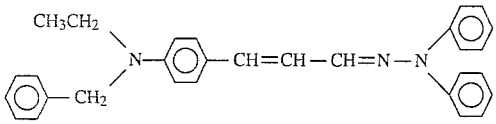

which is prepared from a reaction mixture comprising N-ethyl-N-benzyl cinnamaldehyde and a hydrazine compound represented by the following formula:

(2a)

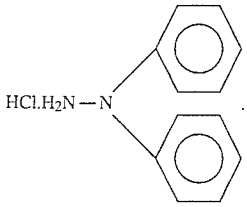

6. The photoreceptor of claim 1, wherein said hydrazone compound is represented by the following formula:

(5)

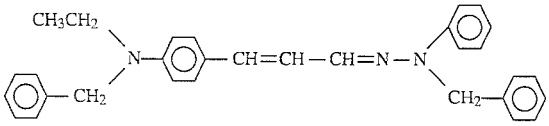

which is prepared from a reaction mixture comprising N-ethyl-N-benzyl cinnamaldehyde and a hydrazine compound represented by the following formula:

(5a)

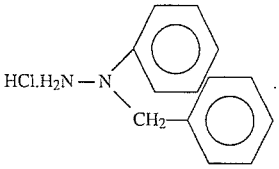

7. The photoreceptor of claim 1, wherein said hydrazone compound is represented by the following formula:

(6)

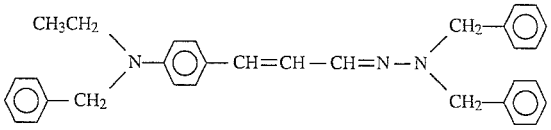

which is prepared from a reaction mixture comprising N-ethyl-N-benzyl cinnamaldehyde and a hydrazine compound represented by the following formula:

(6a)

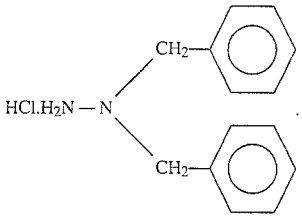

8. The photoreceptor of claim 1, wherein said charge generation layer is interposed between said substrate and said charge transport layer.

9. The photoreceptor of claim 1, wherein said charge generation layer has a thickness between 0.01 $g/m^2$ and 4 $g/m^2$.

10. The photoreceptor of claim 1, wherein said charge generation layer has a thickness between 0.04 $g/m^2$ and 2 $g/m^2$.

11. The photoreceptor of claim 1, wherein said charge transport layer has a thickness between 3 μm and 50 μm.

12. The photoreceptor of claim 1, wherein said charge transport layer has a thickness between 12 μm and 25 μm.

13. The photoreceptor of claim 1, wherein said charge generation material is selected from the group consisting of selenium, selenium-tellurium alloy, selenium-arsenic alloy, cadmium, sulfide, phthalocyanine pigment, perinone pigment, thioindigo pigment, quinacridone pigment, perylene pigment, anthraquinone pigment azo pigment, bisazo pigment, cyanine pigment and squaraine pigment.

14. The photoreceptor of claim 1, wherein said charge generation material is a mixture of phthalocyanine pigment and squaraine pigment.

15. The photorecptor of claim 1, wherein said hydrazone compound is selected from the group consisting of the compounds represented by the following formulas:

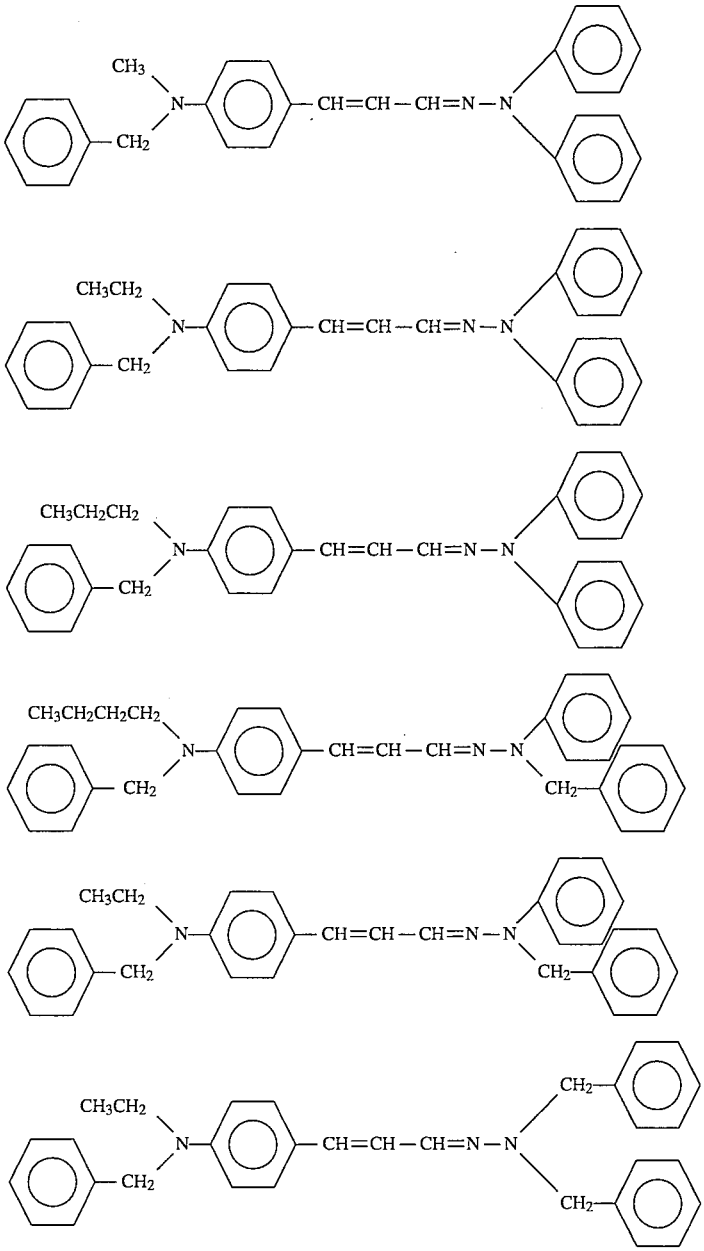

-continued
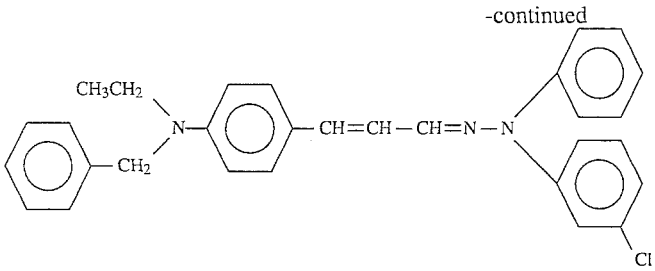
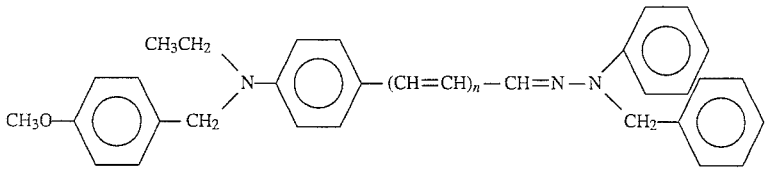
n is an interger of 1 or 2
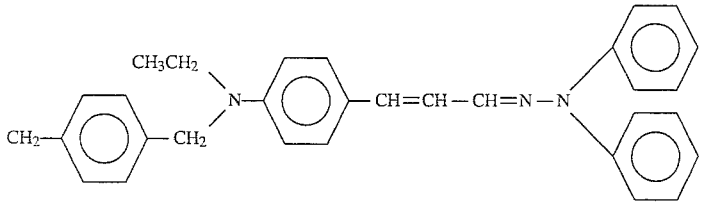
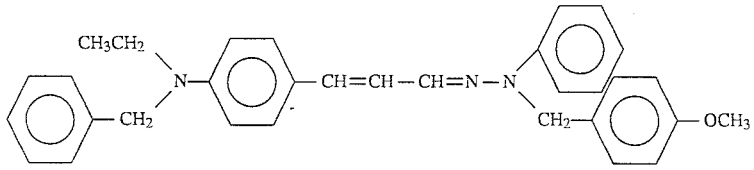
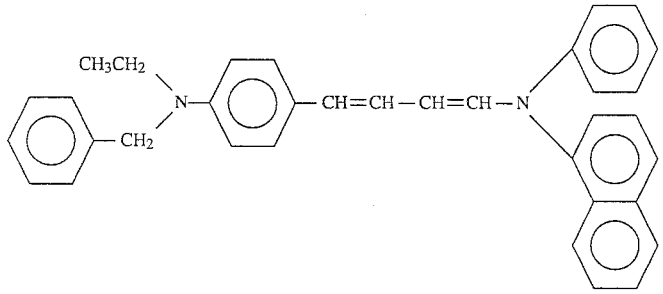
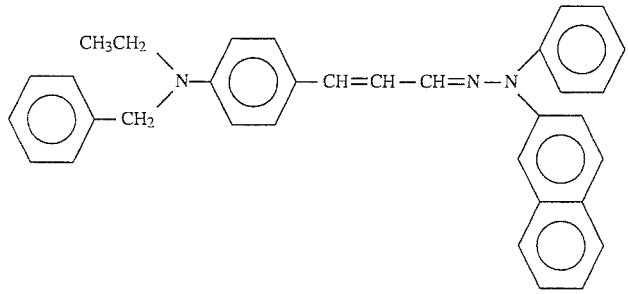
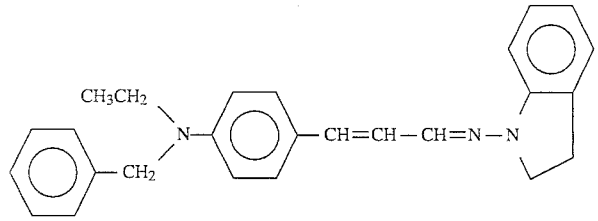

-continued
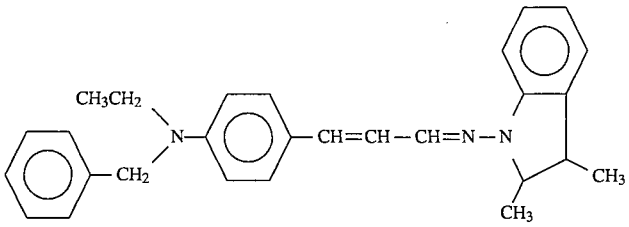
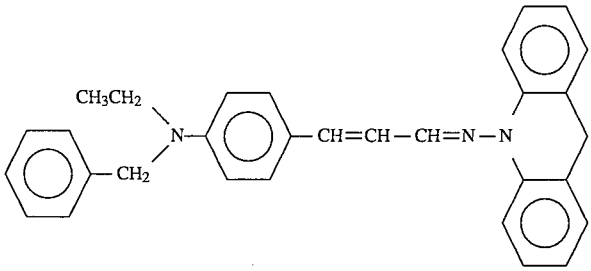
* * * * *